US010813425B2

(12) United States Patent
Shen et al.

(10) Patent No.: US 10,813,425 B2
(45) Date of Patent: Oct. 27, 2020

(54) SUNSHADE AND SUNSHADE BASE THEREOF

(71) Applicant: Zhejiang Yotrio Group Co., Ltd., Linhai (CN)

(72) Inventors: Honghua Shen, Linhai (CN); Jianqiang Xie, Linhai (CN)

(73) Assignee: Zhejiang Yotrio Group Co., Ltd., Linhai (CN)

( * ) Notice: Subject to any disclaimer, the term of this patent is extended or adjusted under 35 U.S.C. 154(b) by 0 days.

(21) Appl. No.: 16/507,161

(22) Filed: Jul. 10, 2019

(65) Prior Publication Data

US 2020/0015557 A1 Jan. 16, 2020

(30) Foreign Application Priority Data

Jul. 10, 2018 (CN) ..... 2018 2 1092263 U

(51) Int. Cl.

*A45B 25/02* (2006.01)
*E04H 12/22* (2006.01)
*A45B 23/00* (2006.01)

(52) U.S. Cl.

CPC ..... *A45B 25/02* (2013.01); *A45B 23/00* (2013.01); *E04H 12/2238* (2013.01); *A45B 2023/0006* (2013.01)

(58) Field of Classification Search

CPC . A45B 25/02; A45B 23/00; A45B 2023/0006; A45B 2025/003; E04H 12/2238
See application file for complete search history.

(56) References Cited

U.S. PATENT DOCUMENTS 5,060,907 A * 10/1991 Castano ..... E04H 12/2238 248/514
5,499,644 A * 3/1996 Geniele ..... A45B 17/00 135/20.1
6,889,953 B2 * 5/2005 Harbaugh ..... E04H 12/2246 135/16
8,632,045 B2 * 1/2014 Ma ..... A45B 23/00 135/16
8,636,020 B2 * 1/2014 Li ..... A45B 25/14 135/16
8,833,709 B2 * 9/2014 Weng ..... A45B 23/00 135/16

(Continued)

*Primary Examiner* — Noah Chandler Hawk
(74) *Attorney, Agent, or Firm* — Schwegman Lundberg & Woessner, P.A.

(57) ABSTRACT

This invention provides a sunshade and a sunshade base thereof. The sunshade base, configured to be connected with a sunshade rod to support a sunshade top, the sunshade includes: a support, an upper side of the support is provided with a connection member for being connected with the sunshade rod; a moving assembly, rolling or sliding to drive the support to move; and a counterweight, the support has a counterweight area for supporting the counterweight. When the sunshade needs to be moved, it only needs to drive the moving assembly to roll or slide, thereby driving the support and the whole sunshade to move. Compared with the prior art in which several people is required to work together to move the sunshade, this invention greatly reduces the labor intensity of moving the sunshade, thereby making the moving of the sunshade more time-saving and labor-saving.

18 Claims, 4 Drawing Sheets

(56) References Cited

U.S. PATENT DOCUMENTS

| | | | | |
|---|---|---|---|---|
| 8,899,249 | B2 * | 12/2014 | Lai | F16M 11/24 135/16 |
| 9,540,840 | B2 * | 1/2017 | Ma | F16M 13/00 |
| 10,426,234 | B1 * | 10/2019 | Volin | A45B 17/00 |
| 10,508,465 | B2 * | 12/2019 | Pan | E04H 12/2246 |
| 2004/0069922 | A1 * | 4/2004 | Wu | E04H 12/2246 248/519 |
| 2007/0102031 | A1 * | 5/2007 | Edenso | B62B 5/049 135/15.1 |
| 2008/0224016 | A1 * | 9/2008 | Defu | E04H 12/2246 248/523 |
| 2017/0114563 | A1 * | 4/2017 | Ye | A45B 11/00 |
| 2019/0360229 | A1 * | 11/2019 | Vanderminden | E04H 15/28 |

* cited by examiner

SUNSHADE AND SUNSHADE BASE THEREOF

CROSS-REFERENCE TO RELATED APPLICATIONS

This Non-provisional application claims priority under 35 U.S.C. § 119(a) on Chinese Patent Application No(s). 201821092263.X filed on Jul. 10, 2018, the entire contents of which are hereby incorporated by reference.

BACKGROUND OF THE INVENTION

Field of the Invention

This invention relates to a technical field of an umbrella and, more particularly, to a sunshade and a sunshade base thereof.

Description of the Related Art

With continuous development of society, sunshades, which have functions of blocking the sunlight and providing shade, have been widely used in homes, swimming pools, hotels, guesthouses, and other entertainment places. The sunshade is usually supported by a sunshade base, and the weight of the sunshade base is an important factor in the stable support of the sunshade body. The sunshade base has to be heavy enough to support the heavy sunshade body. Therefore, the sunshade is generally heavy and difficult to transport and move. If the position of the sunshade is going to be adjusted, it will take much time and effort, and sometimes it needs to take even several people to work together to move sunshade.

BRIEF SUMMARY OF THE INVENTION

In view of this, the first objective of this invention is to provide a sunshade base, and a structural design of the sunshade base can effectively solve the problems of time consuming and laboriousness when the sunshade is moved. The second objective of this invention is to provide a sunshade including the above-mentioned sunshade base.

In order to achieve the above-mentioned first objective, this invention provides the following technical solution:

A sunshade base, configured to be connected with a sunshade rod to support a sunshade top, the sunshade base including:

a support, an upper side of the support being provided with a connection member for being connected with the sunshade rod;

a moving assembly, rolling or sliding to drive the support to move; and a counterweight, the support having a counterweight area for supporting the counterweight.

Optionally, in the above-mentioned sunshade base, the moving assembly may be a wheel.

Optionally, in the above-mentioned sunshade base, the support may include a frame and a supporting rod disposed at an inner side of the frame, and two ends of the supporting rod may be connected with the frame.

Optionally, in the above-mentioned sunshade base, one of the inner side of the frame and the end of the supporting rod may be provided with engaging portions and the other one may be provided with engaging slots, and the supporting rod may be disposed at the frame by engaging the engaging portions inside the engaging slots.

Optionally, in the above-mentioned sunshade base, the supporting rod may divide the inner side of the frame into a plurality of counterweight areas, and a bottom side of the frame and a bottom side of the supporting rod may be respectively provided with a supporting plate for supporting the counterweight.

Optionally, in the above-mentioned sunshade base, the frame may be square, four corners of the square frame may be provided with wheels, and the wheels at two ends of at least one edge of the frame may be universal wheels.

Optionally, in the above-mentioned sunshade base, the frame may include a plurality of connecting rods connected end to end in sequence, and ends of any two adjacent connecting rods may be fixedly connected by an engaging pin.

Optionally, in the above-mentioned sunshade base, an upper surface of the counterweight may be provided with two opposite handheld slots.

Optionally, in the above-mentioned sunshade base, the connection member may be provided with an inserting slot for placing the sunshade rod.

A sunshade includes a sunshade top, a sunshade rod, and a sunshade base. The sunshade base is the sunshade base according to any one of the above.

The sunshade base provided in this invention is mainly used for being connected with the sunshade rod and for supporting the sunshade rod and the sunshade top. The above-mentioned sunshade base includes the support, the moving assembly, and the counterweight. The upper side of the support is provided with the connection member configured to be connected with the sunshade rod. The sunshade rod is connected with the connection member to allow the sunshade base to support the sunshade rod and the sunshade top. The moving assembly is disposed at a lower side of the support, and the moving assembly can roll or slide to drive the support to move, thereby achieving the moving of the whole sunshade. The support is provided with counterweight areas for supporting the counterweights, and the counterweights are placed in the counterweight areas or taken out from the counterweight areas to change the whole weight of the sunshade base.

When the sunshade base provided by the above-mentioned embodiment is applied, and when the sunshade needs to be moved, it only needs to drive the moving assembly to roll or slide, thereby driving the support and the whole sunshade to move. Compared with the prior art in which several people is required to work together to move the sunshade, this invention greatly reduces the labor intensity of moving the sunshade, thereby making the moving of the sunshade more time-saving and labor-saving.

In order to achieve the above-mentioned second objective, this invention further provides a sunshade, and the sunshade includes any of the above-mentioned sunshade bases. Since the above-mentioned sunshade base has the above-mentioned technical effects, the sunshade having the sunshade base should also have corresponding technical effects.

BRIEF DESCRIPTION OF THE DRAWINGS

In order to more clearly illustrate the embodiments of this invention or the technical solutions in the prior art, the accompanying drawings used in the embodiments or the prior art will be briefly introduced below. Obviously, the accompanying drawings described below only refer to some embodiments of this invention, and for persons having ordinary skill in the art, other drawings can be obtained from these drawings without creative efforts.

In FIG. 1 to FIG. 4:

Figure 1:
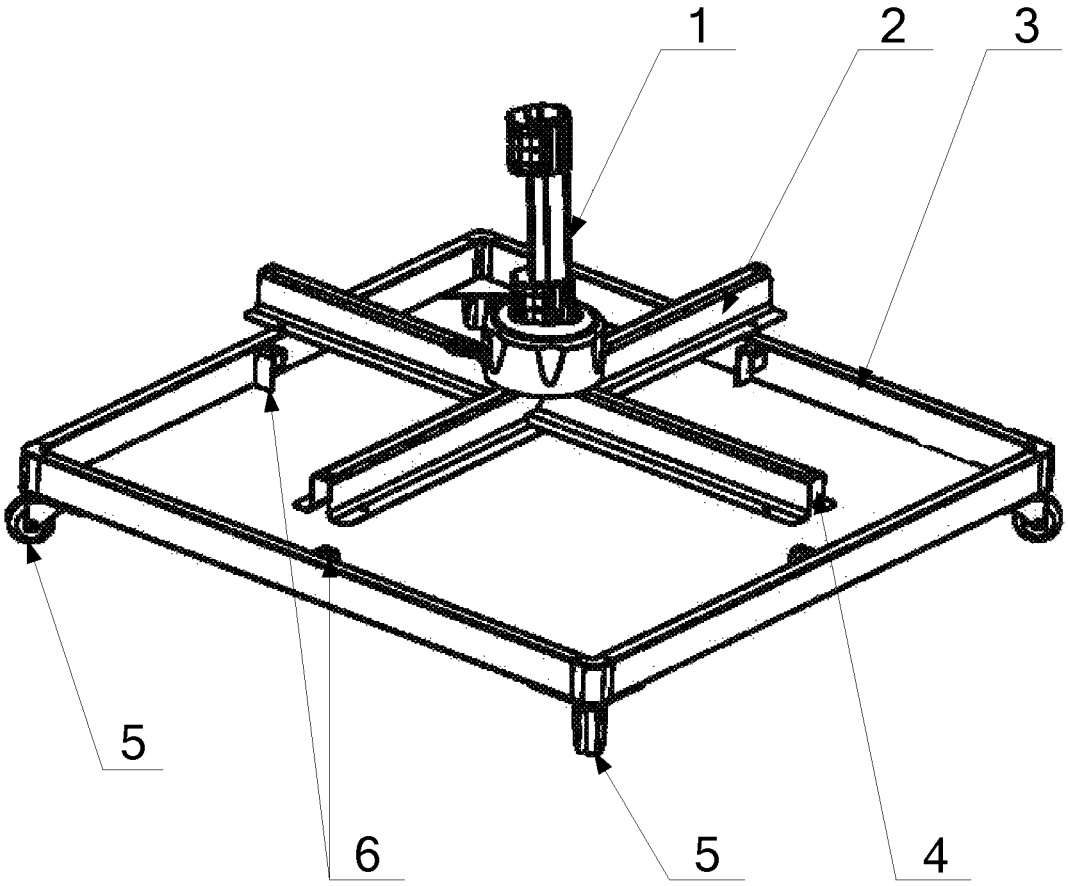
FIG. 1 is a partial assembly diagram of a sunshade base according to an embodiment of this invention.

1—connection member, 2—supporting rod, 3—surrounding pipe, 4—engaging slot, 5—universal wheel, 6—engaging portion, 7—counterweight, 7*a*—handheld slot, and 8—engaging pin; and A—sunshade top, B—sunshade rod, and C—sunshade base.

DETAILED DESCRIPTION OF THE INVENTION

The first objective of this invention is to provide a sunshade base, and a structural design of the sunshade base can effectively solve the problems of time consuming and laboriousness when the sunshade is moved. The second objective of this invention is to provide a sunshade including the above-mentioned sunshade base.

The technical solution in the embodiments of this invention will be clearly and completely described below in combination with the accompanying drawings in the embodiments of this invention. Obviously, the described embodiments are only part of the embodiments of this invention, not all of the embodiments. Based on the embodiments of this invention, all other embodiments obtained by persons having ordinary skill in the art without creative efforts are within the protection scope of this invention.

In the description of this invention, it is to be understood that the orientation or positional relationship of the terms "upper", "lower", "front", "back", "left", and "right" as shown in the drawings are merely for the convenience of simplified description for this invention, and is not intended to indicate or imply that the referred position or element must have a particular orientation, and be constructed and operated in a particular orientation. Therefore, these cannot be understood to be the limitation to this invention. Moreover, the terms "first" and "second" are only used for descriptive purposes and are not to be understood as indicating or implying relative importance.

Figure 2:
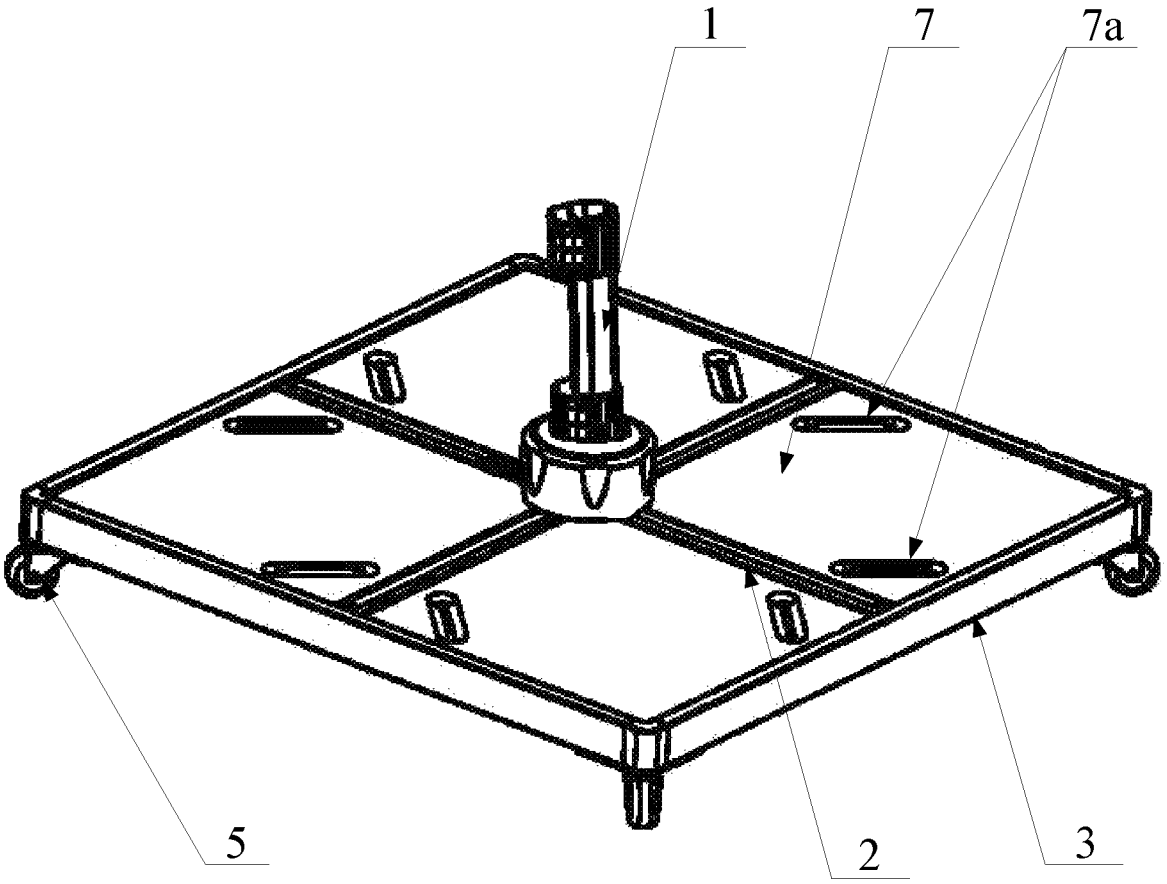
FIG. 2 is a structural schematic diagram of the sunshade base according to the embodiment of this invention.
Figure 3:
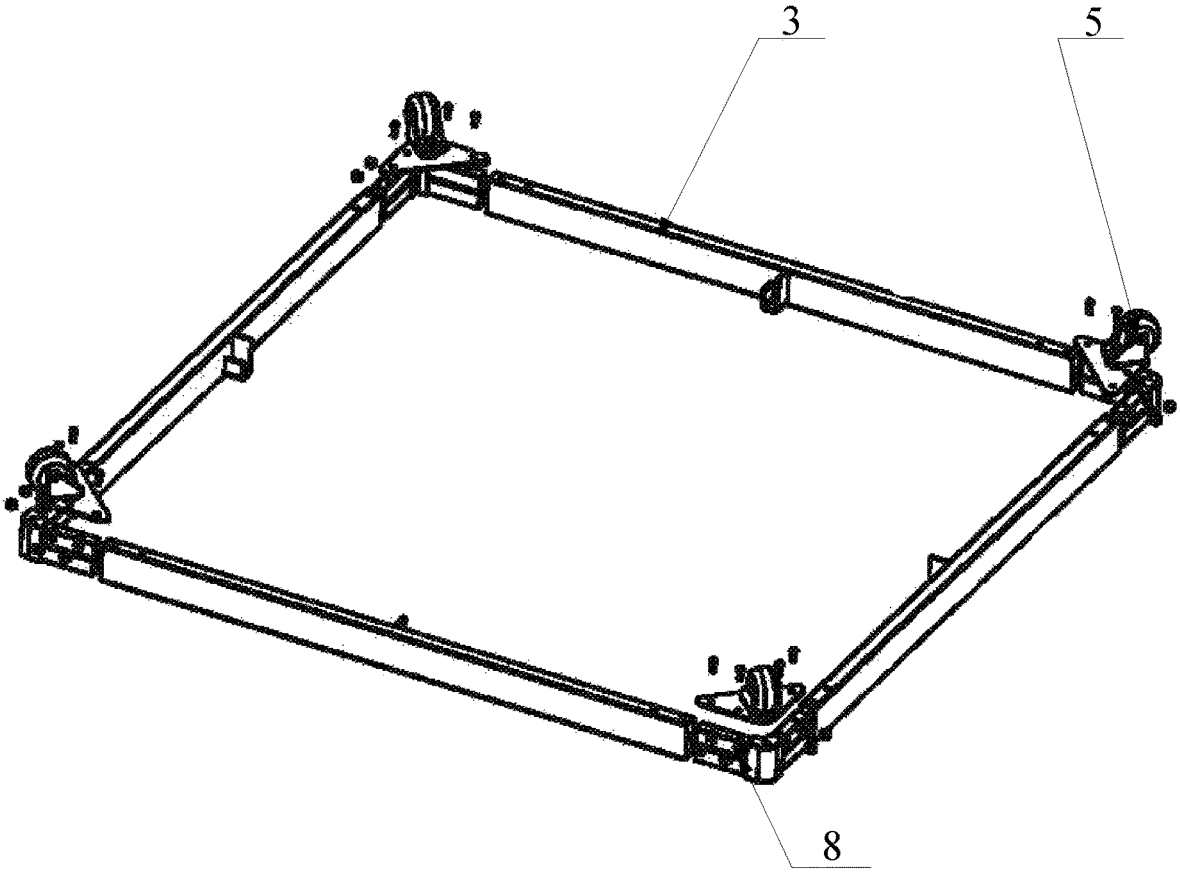
FIG. 3 is a structural schematic diagram of a bottom of a frame according to the embodiment of this invention.

Please refer to FIG. 1 to FIG. 3. A sunshade base C provided in this invention is mainly used for being connected with a sunshade rod B and for supporting the sunshade rod B and a sunshade top A. The sunshade base C includes a support, a moving assembly, and a counterweight 7. In this embodiment, there is a plurality of counterweights 7. An upper side of the support is provided with a connection member 1 configured to be connected with the sunshade rod B. The sunshade rod B is connected with the connection member 1 to allow the sunshade base C to support the sunshade rod B and the sunshade top A. The moving assembly is disposed at a lower side of the support, and the moving assembly can roll or slide to drive the support to move, thereby achieving the moving of the whole sunshade. The support is provided with counterweight areas for supporting the counterweights 7, and the counterweights 7 are placed in the counterweight areas or taken out from the counterweight areas to change the whole weight of the sunshade base C.

When the sunshade base C provided by the above-mentioned embodiment is applied, and when the sunshade needs to be moved, it only needs to drive the moving assembly to roll or slide, thereby driving the support and the whole sunshade to move. Compared with the prior art in which several people is required to work together to move the sunshade, this invention greatly reduces the labor intensity of moving the sunshade, thereby making the moving of the sunshade more time-saving and labor-saving.

In one specific embodiment, the above-mentioned moving assembly may include a sliding rail and a sliding component cooperating with the sliding rail. The sliding component is fixed at the bottom of the support, and the sliding component slides along the sliding rail to allow the support to slide along the sliding rail, thereby achieving the moving of the whole sunshade.

Alternatively, the moving assembly may also be wheels, and the wheels roll to achieve the moving of the support. Preferably, the number of the wheels may be plural, and a plurality of wheels may all be universal wheels 5, or any two wheels arranged side by side may be universal wheels 5, which is not limited herein.

In the above-mentioned embodiment, the support may include a frame, and the counterweight areas are located at an inner side of the frame, that is, the counterweights 7 may be placed inside the frame. The support may also include supporting rods 2 disposed at the inner side of the frame, and both two ends of the supporting rods 2 are connected with the frame, such that the structure of the support is stabler. The number of the supporting rods 2 may be plural, and a plurality of supporting rods 2 can be arranged side by side or can be cross-arranged. For example, the number of the supporting rods 2 is two, and the two supporting rods 2 are arranged perpendicular to each other and are cross-arranged, which is not limited herein.

In order to facilitate the disassembly of the supporting rods 2, one of the inner side of the frame and the ends of the supporting rod 2 is provided with engaging portions band the other one is provided with engaging slots 4, and the supporting rods 2 are disposed at the frame by engaging the engaging portions 6 inside the engaging slots 4. That is, the inner side of the frame is provided with the engaging portions 6, the ends of the supporting rods 2 are provided with the engaging slots 4, and the engaging portions 6 are engaged inside the engaging slots 4 to achieve the connection of the supporting rods 2 with the frame, such that it only needs to take out the supporting rods 2 from the frame during disassembly. The above-mentioned engaging portions 6 may be protrusion platforms, and the engaging slots 4 may be U-shaped slots. Certainly, the engaging slots 4 can also be located at the frame, and the engaging portions 6 can be located at the ends of the supporting rods 2, which is not limited herein.

It should be noted that, when the engaging slots 4 are located at the supporting rods 2, the mouths of the slots are arranged to face downward; and when the engaging slots 4 are located at the frame, the mouths of the slots are arranged to face upward. The engaging portions 6 can relatively move along the vertical direction when entering and exiting the engaging slots 4. Certainly, the support rods 2 and the frame can also be directly welded together, which is not limited herein.

In the above-mentioned embodiment, the supporting rods 2 divide the inner side of the frame into a plurality of counterweight areas, and at least one counterweight 7 can be placed in each counterweight area, such that the weight of the whole sunshade base C can be adjusted by adjusting the number of the counterweights 7.

In order to facilitate supporting the counterweights 7, both the bottom side of the frame and bottom sides of the supporting rods 2 are provided with supporting plates for supporting the counterweights 7. In this way, after the counterweights 7 are placed in the counterweight areas, the supporting plates abuts against the bottoms of the counterweights 7 to support the counterweights 7. At the same time, upper sides of the counterweights 7 are flush with the upper side of the frame, ensuring the overall beauty and simplicity of the whole sunshade base C. Certainly, the counterweights 7 can also be directly supported by the supporting rods 2 and the frame, that is, the support rods 2 and the frame abut against the bottoms of the counterweights 7 to support the counterweights 7, which is not limited herein.

In another embodiment, the supporting rod 2 may be channel steel, the groove of the channel steel forms the above-mentioned engaging slot 4, and flanges/turned edges are provided at the mouths at both sides of the channel steel to form the above-mentioned supporting plates. Certainly, the supporting rods 2 can also adopt other structures, such as metal round rods, which is not limited herein.

The above-mentioned frame may be in any shape such as a square or a circle. When the above-mentioned frame is square, four corners of the square frame are all provided with wheels.

In order to facilitate changing the directions, the wheels at two ends of at least one edge of the frame are universal wheels.

In addition, the frame may include a plurality of connecting rods connected end to end in sequence, and the ends of any two adjacent connecting rods are fixedly connected by an engaging pin 8. That is, a plurality of connecting rods is connected end to end in sequence to form the frame. The engaging pin 8 may include a first edge and a second edge, and an angle is formed between the first edge and the second edge. The first edge is fixedly connected with one connecting rod, and the second edge is fixedly connected with another connecting rod, such that the fixed connection of ends of two adjacent surrounding pipes 3 is achieved. Wherein, the first edge and one connecting rod can be connected via a bolt or by being welded together, and the second edge and another connecting rod can also be connected by the bolt or by being welded together, which is not limited herein.

Wherein, the above-mentioned connecting rod can be the surrounding pipe 3. The first edge of the engaging pin 8 extends into one surrounding pipe 3 and the two are fixedly connected by screw(s), and the second edge of the engaging pin 8 extends into another surrounding pipe 3 and the two are connected by screw(s), such that the ends of two adjacent surrounding pipes 3 are fixedly connected.

Certainly, a plurality of connecting rods can also be directly welded, which is not limited herein.

In order to facilitate the transportation of the counterweight 7, the upper surface of the counterweight 7 may be provided with two opposite handheld slots 7*a*. With this arrangement, fingers can be inserted into the handheld slots 7*a* to apply force. In order to prevent fingers from scratching, a protective cover may also be disposed at the inner wall of the handheld slot 7*a* and the edge of the mouth of the handheld slot 7*a*, and the protective cover may be a rubber cover or a silicone cover.

In another embodiment, the connection member 1 is provided with an inserting slot for placing the sunshade rod B. It only needs to insert a lower end of the sunshade rod B into the inserting slot to achieve the connection between the sunshade base C and the sunshade rod B. Certainly, the sunshade rod B can also be directly connected with the connection member 1 by a bolt, which is not limited herein.

Figure 4:
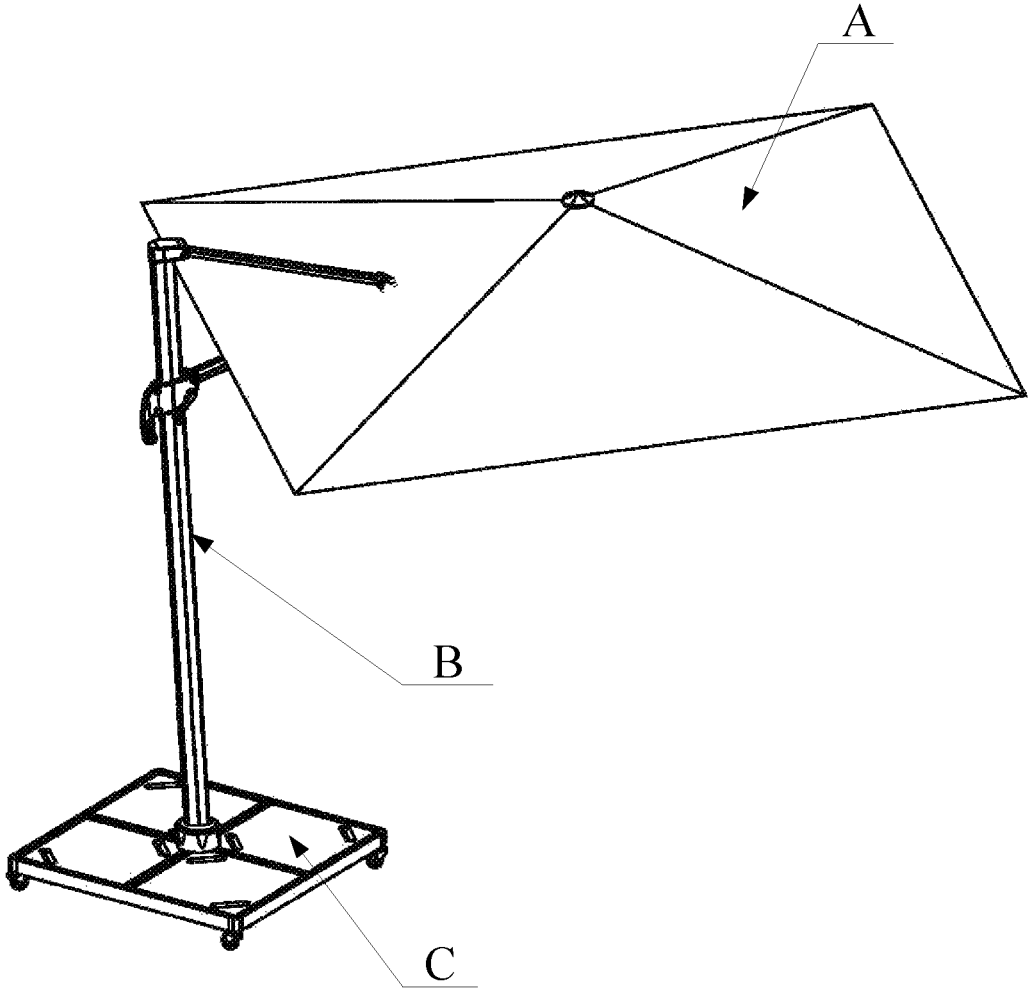
FIG. 4 is a structural schematic diagram of a sunshade according to the embodiment of this invention.

Please refer to FIG. 4. Based on the sunshade base C provided in the above-mentioned embodiments, this invention further provides a sunshade, and the sunshade includes the sunshade top A, the sunshade rod B, and the sunshade base C, wherein the sunshade base C is the sunshade base C according to any one of the above-mentioned embodiments. Since the sunshade adopts the sunshade base C in the above-mentioned embodiments, the beneficial effects of the sunshade can be referred to the above-mentioned embodiments.

The embodiments in this description are described in a progressive manner, each embodiment focuses on different parts compared with other embodiments, and the same and similar parts between these embodiments can be referred to each other.

The above-mentioned description of the provided embodiments enables persons skilled in the art to make or use this invention. A variety of modifications to these embodiments will be obvious to persons skilled in the art. The general principles defined herein may be implemented in other embodiments without departing from the spirit or scope of this invention. Therefore, this invention will not be limited by the embodiments shown herein, but is to be interpreted as the broadest scope consistent with the principles and novel features provided herein.

What is claimed is:

1. A sunshade base, configured to be connected with a sunshade rod to support a sunshade top, the sunshade base comprising:

a support, wherein an upper side of the support is provided with a connection member for being connected with the sunshade rod;

a moving assembly, wherein the moving assembly rolls or slides to drive the support to move; and a plurality of counterweights, wherein the support has a plurality of counterweight areas for supporting at least one of the plurality of counterweights; the counterweights are set to be removable from the counterweight areas so that a whole weight of the sunshade base can be changed by placing the counterweights in or removing from the counterweight areas;

wherein the support comprises a frame and a supporting rod disposed at an inner side of the frame, the supporting rod divides the inner side of the frame into a plurality of counterweight areas; upper sides of the counterweights are flush with an upper side of the frame;

wherein two ends of the supporting rod are connected with the frame;

wherein one of the inner side of the frame and the ends of the supporting rod is provided with engaging portions and the other one is provided with engaging slots, and the supporting rod is disposed at the frame by engaging the engaging portions inside the engaging slots.

2. The sunshade base according to claim 1, wherein the moving assembly is a wheel.

3. The sunshade base according to claim 1, wherein a bottom side of the frame and a bottom side of the supporting rod are respectively provided with a supporting plate for supporting the counterweight.

4. The sunshade base according to claim 3, wherein an upper surface of each counterweight is provided with two opposite handheld slots.

5. The sunshade base according to claim 3, wherein the connection member is provided with an inserting slot for placing the sunshade rod.

6. A sunshade, comprising the sunshade top, the sunshade rod, and the sunshade base, wherein the sunshade base is the sunshade base as claimed in claim 3.

7. The sunshade base according to claim 1, wherein the frame is square, four corners of the square frame are provided with wheels, and the wheels at two ends of at least one edge of the frame are universal wheels.

8. The sunshade base according to claim 1, wherein the frame comprises a plurality of connecting rods connected end to end in sequence, and ends of any two adjacent connecting rods are fixedly connected by an engaging pin.

9. The sunshade base according to claim 1, wherein an upper surface of each counterweight is provided with two opposite handheld slots.

10. A sunshade, comprising the sunshade top, the sunshade rod, and the sunshade base, wherein the sunshade base is the sunshade base as claimed in claim 9.

11. The sunshade base according to claim 1, wherein the connection member is provided with an inserting slot for placing the sunshade rod.

12. A sunshade, comprising the sunshade top, the sunshade rod, and the sunshade base, wherein the sunshade base is the sunshade base as claimed in claim 1.

13. The sunshade base according to claim 1, wherein an upper surface of each counterweight is provided with two opposite handheld slots.

14. The sunshade base according to claim 1, wherein an upper surface of each counterweight is provided with two opposite handheld slots.

15. The sunshade base according to claim 1, wherein the connection member is provided with an inserting slot for placing the sunshade rod.

16. The sunshade base according to claim 1, wherein the connection member is provided with an inserting slot for placing the sunshade rod.

17. A sunshade, comprising the sunshade top, the sunshade rod, and the sunshade base, wherein the sunshade base is the sunshade base as claimed in claim 1.

18. A sunshade, comprising the sunshade top, the sunshade rod, and the sunshade base, wherein the sunshade base is the sunshade base as claimed in claim 1.

* * * * *